US007894961B2

(12) United States Patent
Blackburn et al.

(10) Patent No.: US 7,894,961 B2
(45) Date of Patent: Feb. 22, 2011

(54) DUMP CYCLE COUNTING AND MONITORING SYSTEM

(75) Inventors: Mark Robert Blackburn, Cambs (GB); Robert Todd, Houghton le Spring (GB); Roger Tansley, Darlington (GB)

(73) Assignee: Caterpillar Inc, Peoria, IL (US)

( * ) Notice: Subject to any disclaimer, the term of this patent is extended or adjusted under 35 U.S.C. 154(b) by 1283 days.

(21) Appl. No.: 10/986,190

(22) Filed: Nov. 12, 2004

(65) Prior Publication Data

US 2006/0104404 A1 May 18, 2006

(51) Int. Cl.
*G06G 7/00* (2006.01)
*G06M 3/00* (2006.01)

(52) U.S. Cl. ..... 701/50; 701/1; 701/29; 701/30; 701/35; 701/200; 701/213; 342/357.01; 342/357.06; 377/28; 377/29; 377/31; 180/271; 180/290

(58) Field of Classification Search ..... 701/1, 701/29, 30, 35, 50, 200, 213; 342/357.01, 342/357.06; 377/27, 28, 31; 180/271, 290
See application file for complete search history.

(56) References Cited

U.S. PATENT DOCUMENTS 3,969,703 A * 7/1976 Kwiatkowski et al. ..... 700/13
4,230,196 A * 10/1980 Snead ..... 177/141
4,542,461 A 9/1985 Eldridge et al.
4,635,739 A * 1/1987 Foley et al. ..... 177/45
4,839,835 A 6/1989 Hagenbuch
4,949,263 A 8/1990 Jurca
5,105,895 A 4/1992 Kyrtsos
5,327,347 A * 7/1994 Hagenbuch ..... 701/50
5,493,798 A 2/1996 Rocke et al.
5,509,293 A 4/1996 Karumanchi
5,528,499 A 6/1996 Hagenbuch
5,564,507 A * 10/1996 Matsushita et al. ..... 172/3
5,631,832 A 5/1997 Hagenbuch
5,650,928 A 7/1997 Hagenbuch
5,650,930 A 7/1997 Hagenbuch
5,659,470 A 8/1997 Goska et al.
5,714,719 A 2/1998 Otsuka et al.

(Continued)

FOREIGN PATENT DOCUMENTS

EP 1 345 182 9/2003

OTHER PUBLICATIONS

Caterpillar Inc., Service Manual: Truck Payload Measurement System With Real Time Clock, Form No. SENR4733, 1990 (11 pages including cover page, pp. 5-8 and 10-14, and back page).

*Primary Examiner*—Jack Keith
*Assistant Examiner*—Chuong P Nguyen
(74) *Attorney, Agent, or Firm*—Finnegan, Henderson, Farabow, Garrett & Dunner LLC

(57) ABSTRACT

A dump cycle counting system is provided for a work machine. The system may include a payload carrier configured to contain a payload of material and a dump actuator configured to effectuate dumping of the payload out of the payload carrier. The system may also include a controller configured to control actuation of the dump actuator and a dump control device operatively coupled to the controller. The system may further include a load counter configured to record at least one dump cycle based on a command state of at least one of the dump control device and the controller.

40 Claims, 5 Drawing Sheets

U.S. PATENT DOCUMENTS

| | | | | |
|---|---|---|---|---|
| 5,742,914 | A | 4/1998 | Hagenbuch | |
| 5,815,826 | A | 9/1998 | Henderson et al. | |
| 5,848,368 | A | 12/1998 | Allen et al. | |
| 5,944,764 | A * | 8/1999 | Henderson et al. | 701/50 |
| 5,955,706 | A | 9/1999 | Fonkalsrud et al. | |
| 5,995,888 | A | 11/1999 | Hagenbuch | |
| 6,026,341 | A * | 2/2000 | Harrod | 701/50 |
| 6,211,471 | B1 * | 4/2001 | Rocke et al. | 177/136 |
| 6,263,039 | B1 * | 7/2001 | Ducharme | 377/15 |
| 6,264,548 | B1 * | 7/2001 | Payne et al. | 454/157 |
| 6,518,519 | B1 | 2/2003 | Crane, III et al. | |
| 6,552,279 | B1 | 4/2003 | Lueschow et al. | |
| 6,601,013 | B2 | 7/2003 | Lueschow et al. | |
| 6,721,680 | B2 | 4/2004 | Sorrells et al. | |
| 7,276,669 | B2 * | 10/2007 | Dahl et al. | 177/45 |
| 2002/0161502 | A1 | 10/2002 | McCaherty | |
| 2003/0176958 | A1 | 9/2003 | Hagenbuch | |

* cited by examiner

DUMP CYCLE COUNTING AND MONITORING SYSTEM

TECHNICAL FIELD

The present disclosure is directed to a dump cycle counting system, and more particularly to a system for monitoring a dump command state and for updating a dump cycle counter.

BACKGROUND

Keeping track of the number of loads carried by a hauling vehicle may be desirable for several reasons. For example, the number of loads carried by the vehicle may be considered when determining its value depreciation over time. The more loads it has carried, the more dumps it will have made, which may be an indication of the level of wear and tear on the dump mechanism, and thus may affect the resale value of the vehicle. Similarly, the number of loads may be monitored to assist in determining when scheduled maintenance may be appropriate. Some components may be serviced or replaced after a predetermined number of dump cycles. Also, counting the number of loads carried by a hauling vehicle may be used for billing purposes, particularly when one involved party is either paying or getting paid by the load, or by the amount of material hauled.

Historically, load counts have been kept by handwritten tally in log books or the like. However, this method can be unreliable due to honest mistake, or intentional "padding" of the load count (i.e., fraudulently recording more loads than were actually made).

Load counts have also been kept using dump body position sensors. Such sensors are often contact sensors that complete an electrical circuit when the dump body resides in a fully lowered position. When the dump body is raised, the sensor contact is broken and a dump cycle is recorded. Such a system can eliminate some mistakes in recordation. Nevertheless, this type of system may still be subject to "padding" because an operator need only raise the dump body by a small amount, such as one to two inches in order to record a fraudulent dump cycle.

Certain dump cycle counting systems have been proposed for automatically monitoring the dump cycles for a machine. For example, U.S. Pat. No. 6,263,039 to Ducharme (hereinafter "the '039 patent") discloses a counting system that monitors the output of a load body position control device. The system of the '039 patent monitors electrical current indicative of the dumping of the machine's dump body. In one embodiment, the '039 patent monitors both initiation and cessation of the current and thus determines that a full dump cycle has been completed and only then does it record a dump cycle.

While the system of the '039 patent may be suitable in certain applications for automatically monitoring and counting the number of dump cycles for a machine, the system has several shortcomings. For example, because the system of the '039 patent relies on the measurement of a current level of an electrical signal to operate, the system must include one or more sensors for determining this current level. These sensors add complexity and cost to the system for the '039 patent. Further, the sensors may negatively impact the reliability of the system. In addition, the system of the '039 patent may not be easily retrofitted to a machine due to the addition of various sensors, wiring, etc. that must be installed.

The disclosed dump cycle counting and monitoring system is directed toward overcoming one or more of the problems set forth above.

SUMMARY OF THE INVENTION

In one aspect, the present disclosure is directed to a dump cycle counting system for a work machine. The system may include a payload carrier configured to contain a payload of material and a dump actuator configured to effectuate dumping of the payload out of the payload carrier. The system may also include a controller configured to control actuation of the dump actuator and a dump control device operatively coupled to the controller. The system may further include a load counter configured to record at least one dump cycle based on a command state of at least one of the dump control device and the controller.

In another aspect, the present disclosure is directed to a work machine having a power source, one or more traction devices, and a payload carrier configured to contain a payload of material. The work machine may also include a dump actuator configured to effectuate dumping of the payload out of the payload carrier and a controller configured to control actuation of the dump actuator, as well as a dump control device operatively coupled to the controller. The work machine may further include a load counter configured to record at least one dump cycle based on a command state of at least one of the dump control device and the controller such that the load counter is configured to record the at least one dump cycle once the work machine has exceeded a predetermined ground speed and the command state has remained, for at least a predetermined amount of time, a state corresponding to a dump state.

In another aspect, the present disclosure is directed to a method for operating a dump cycle counting system. The method may include monitoring a command state of at least one of dump control device and a controller operatively coupled to a dump actuator, the dump actuator being configured to effectuate dumping of a payload of material out of a payload carrier. The method may also include recording at least one dump cycle based on the monitored command state.

In another aspect, the present disclosure is directed to a computer readable medium including instructions for monitoring a command state of at least one of a dump control device and a controller operatively coupled to a dump actuator, the dump actuator being configured to effectuate dumping of a payload of material out of a payload carrier. The computer readable medium may also include instructions for recording at least one dump cycle based on the monitored command state.

In another aspect, the present disclosure is directed to a method for retrofitting a dump cycle counting system to a work machine. The method may include configuring a computer readable medium associated with the work machine to include instructions for monitoring a command state of at least one of a dump control device and a controller configured to effectuate dumping of a payload out of a payload carrier and recording at least one dump cycle based on the monitored command state.

DETAILED DESCRIPTION

Reference will now be made in detail to the drawings. Wherever possible, the same reference numbers will be used throughout the drawings to refer to the same or like parts.

Figure 1:
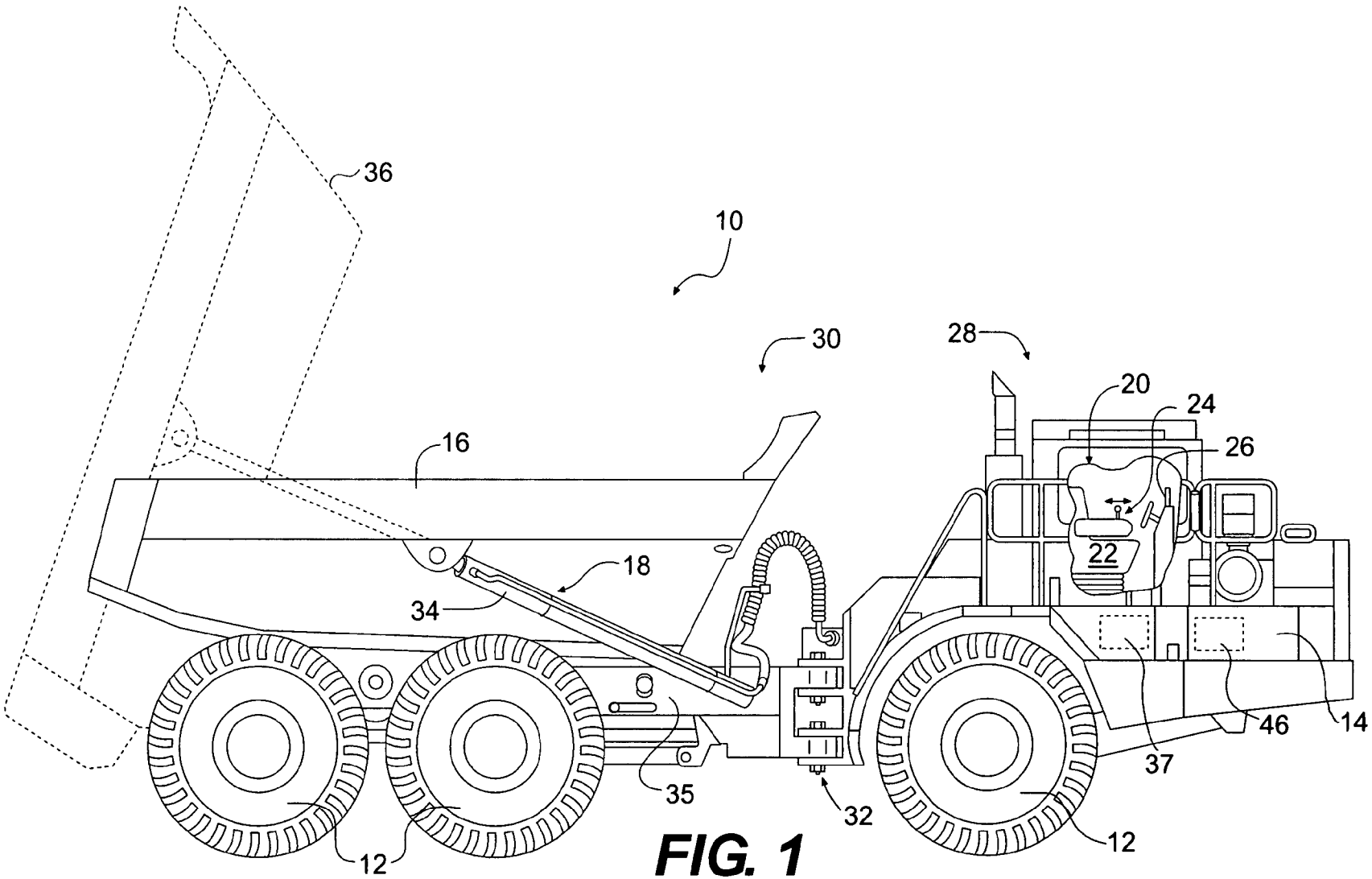
FIG. 1 is a diagrammatic illustration of a work machine according to an exemplary disclosed embodiment.

FIG. 1 illustrates a work machine 10. Work machine 10 may include traction devices 12, a power source 14, a dump body 16, a dump actuator 18, an operator station 20, an operator seat 22, a dump control device 24, and a display 26.

Work machine 10 may be any kind of hauling vehicle, such as, for example, dump trucks, wheel tractor scrapers, towed scrapers, earth movers, etc. Accordingly, traction devices 12 may be any type of traction devices, such as, for example, wheels, as shown in FIG. 1, tracks, belts, or any combinations thereof.

In particular, work machine 10 may be an articulated dump truck, which may include a front portion 28 connected to a rear portion 30 via a hinge-like coupling 32 such that front portion 28 and rear portion 30 may be articulated relative to one another. This may enable better maneuverability of work machine 10 in tight spaces or over rough terrain. Other embodiments may include non-articulated trucks.

Dump body 16 may be any kind of payload carrier configured to carry a payload and dump it on command. The payload may be dumped by actuation of dump actuator 18, which may be a lift cylinder 34. Lift cylinder 34 may be configured to lift dump body 16 up at an angle relative to a frame 35 of work machine 10 (as shown by a dashed outline 36) in order to allow the payload to slide out of dump body 16. Further, work machine 10 may have more than one dump actuator 18. For example, work machine 10 may include two lift cylinders 34, one on each side of dump body 16.

Dump control device 24 may include one or more levers, buttons, switches, pedals, etc. operatively coupled to dump actuator 18. Dump control device 24 may be located at any suitable location on work machine 10. For example, dump control device 24 may be a lever, as shown in FIG. 1, mounted on or near operator seat 22 within operator station 20.

Dump control device 24 may be operatively connected to a controller 37, which may be configured to control actuation of dump actuator 18. Dump control device 24 may be integral with controller 37 or may, alternatively, be a separate unit. Controller 37 may be any electrical and/or mechanical device. For example, dump control device 24 may be operatively coupled to dump actuator 18 by an electro-hydraulic type control system, a hydro-mechanical type control system, or any other type of control system which may include controller 37. In some embodiments, controller 37 may include a mechanical component of one of these systems, particularly in a hydro-mechanical system. For example, controller 37 may be a hydraulic valve or pump. In such embodiments, the command state of controller 37 may correspond to an operating parameter of the hydro-mechanical control system, such as, for example, hydraulic pressure associated with dump actuator 18. Controller 37 may also be a processor, such as for example an electronic control module (ECM) of work machine 10. For purposes of this disclosure, controller 37 will be primarily discussed in terms of a processor. However, it will be understood that controller 37 could be any of the types of devices described above.

Work machine 10 may include display 26 for displaying information to an operator. Display 26 may be any kind of display, including simple indicator lights and/or more sophisticated screen displays, such as, for example, cathode ray tubes (CRTs), liquid crystal displays (LCDs), plasma screens, and the like. Display 26 may provide visual feedback regarding the number of dump cycles completed by work machine 10. Display 26 may also provide other information, which will be discussed in further detail below. Display 26 may provide this information in real time.

Alternatively or additionally, this information may be provided to an entity external to the work machine for analysis or review by any interested parties such as owners, renters, customers, and/or service technicians.

For example, this information may be downloaded (e.g., with a laptop or PDA) or sent to a processing facility as a radio signal, via satellite, or any other type of data link.

Figure 2:
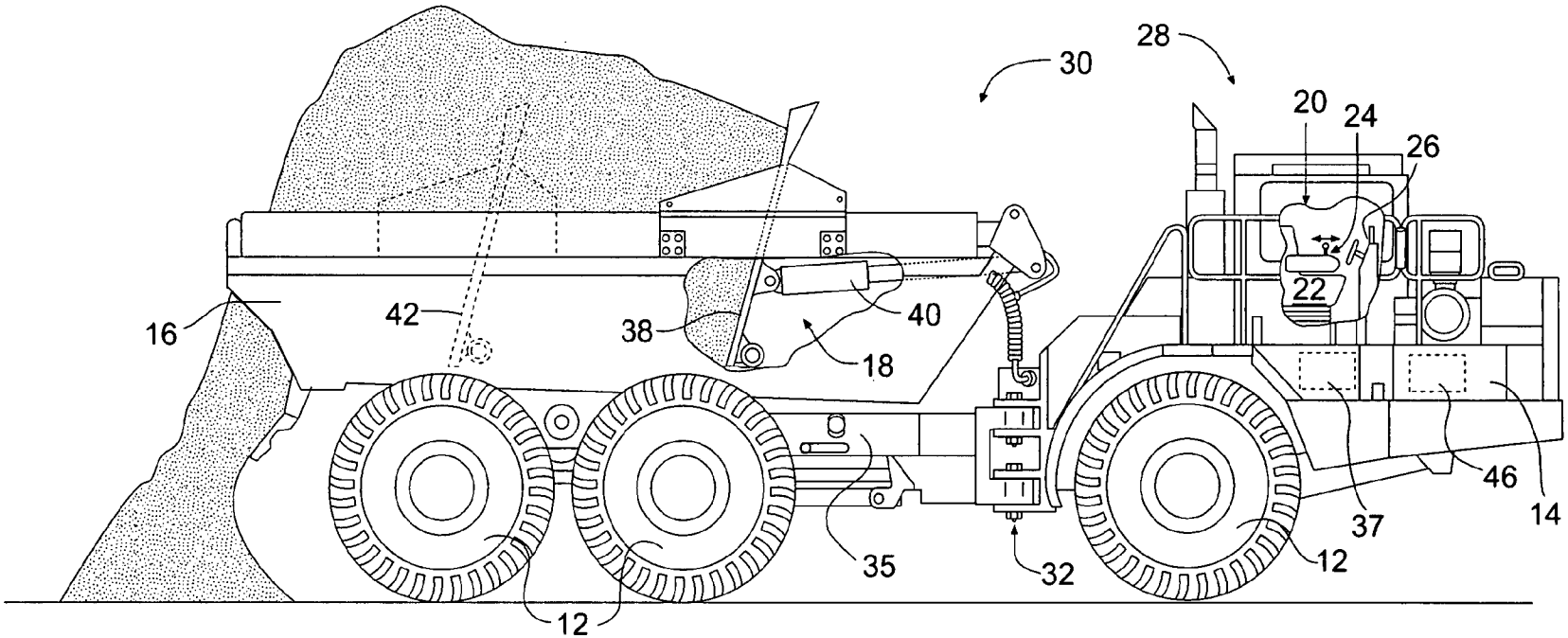
FIG. 2 is a diagrammatic illustration of a work machine according to another exemplary disclosed embodiment.

While work machine 10 may be a dump truck having a liftable dump body 16, as discussed with regard to FIG. 1, work machine 10 may alternatively be an ejector type dump truck. FIG. 2 illustrates an exemplary ejector type dump truck, having an ejector plate 38 for pushing a payload out of dump body 16. Ejector plate 38 may be moved with dump actuator 18. In this embodiment, dump actuator 18 may be an ejector cylinder 40. A dashed outline 42 illustrates ejector plate 38 in a more rearward position as it would be after ejector cylinder 40 has been partially extended.

Figure 3:
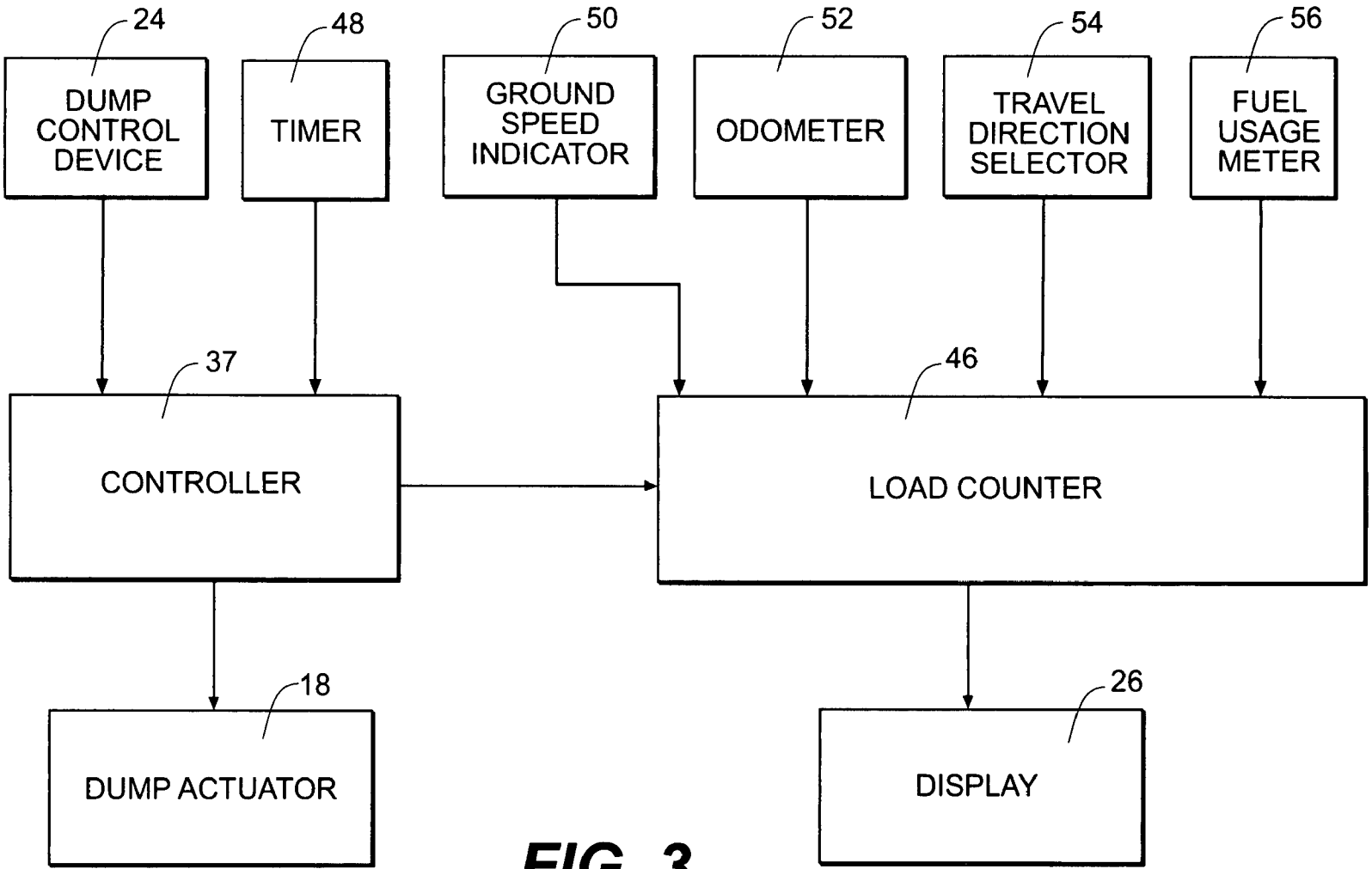
FIG. 3 is a block diagram representation of a dump cycle counting and monitoring system according to an exemplary disclosed embodiment.

The disclosed dump cycle counting and monitoring system may include one or more processors such as controller 37 and/or a load counter 46, as shown in FIG. 3. One of these processors could be eliminated and its functions performed by the other. For example, load counter 46 could be part of controller 37. Alternatively, load counter 46 may be a separate component (with or without a display), as shown in FIG. 3, or part of another controller, such as, for example, an engine control unit (ECU).

FIG. 3 further represents dump control device 24 and a timer 48, from which controller 37 may be configured to receive information. Timer 48 may be an integral part of controller 37 or load counter 46. Alternatively, timer 48 may be a separate component from either of the processors and has been shown this way in FIG. 3 for ease of discussion. Timer 48 may record elapsed time, which may be used to determine operational data for work machine 10. For example, data collected from timer 48 may be used to record the number of hours that work machine 10 has been in operation.

Data collected from timer 48 may also be used, in conjunction with other acquired data, to calculate performance data for work machine 10. For example, data collected from timer 48 may be used (in conjunction with other data) to determine fuel consumption per unit time and/or the number of loads per unit time.

Further, segments of elapsed time as collected from timer 48 may be used in conjunction with other data to determine machine performance during selected segments of time. For example, data collected from timer 48 may be used to calculate the number of loads during a workday or shift.

Also, data from timer 48 may be used to determine the amount of time it takes to perform a certain task, such as, for example a dump cycle. In addition to determining the total amount of time it takes to complete a dump cycle, data collected from timer 48 may be used in conjunction with data from a ground speed indicator 50 to determine the amount of time work machine 10 remained stationary ("wait time") during a dump cycle.

Controller 37 may be configured to receive command signals from dump control device 24 and to control dump actuator 18 based on these signals. Controller 37 may also control one or more other functions of work machine 10.

Load counter 46 may receive information from controller 37, ground speed indicator 50, an odometer 52, a travel direction selector 54, and a fuel usage meter 56. Load counter 46 may store, process, and/or display information from one or more of these various sources. Odometer 52 and/or fuel usage meter 56 may be separate devices or may be incorporated into load counter 46, controller 37, or another controller associated with work machine 10.

Operator input may control the command state of dump control device 24. For example, by pushing a dump control lever into a dump position the command state of dump control device 24 may become a "dump state." The command state of dump control device 24 may affect the command state of controller 37. For example, based on a position/state of a dump control lever, controller 37 may also enter a "dump state." In response to the command state of the controller being a dump state, controller 37 may actuate actuator 18 to effectuate a dump. For example, hydraulic cylinders, such as dump actuator 18, may be extended to effectuate the dump by opening one or more solenoid valves to allow hydraulic fluid to pressurize the cylinder. These solenoid valves may be opened via electronic signals generated by controller 37 in response to input from dump control device 24. Monitoring the command state of dump control device 24 and/or controller 37 may, in effect, monitor the commanded state of the solenoids of these solenoid valves, without actually monitoring output signals of controller 37 or physical or electrical states of the solenoids themselves.

Load counter 46 may be configured to determine the command state of dump control device 24. For example, load counter 46 may be configured to determine a position of a switch associated with dump control device 24, determine the position of dump control device 24 itself, monitor a control signal generated by dump control device 24, or perform any other method of determining the command state of dump control device 24.

Alternatively or additionally, load counter 46 may be configured to determine a command state associated with controller 37. For example, load counter 46 may be configured to determine a memory value associated with or used by controller 37 that is indicative of the command state thereof.

Controller 37 may run one or more routines, and may be configured to generate one or more actuation signals based on its command state. The command state of controller 37 may be determined by inputs from dump control device 24. The routines run by controller 37 may generate or store values indicative of whether a dump has been ordered. The stored values and/or initiation of certain routines, etc. may be determinative of the command state of controller 37.

The stored values may even be an indicator on which controller 37 bases its control of these dump actuator 18. For example, controller 37 may be configured to detect whether a memory value is set to "dump," or a variable representative thereof. For instance, the memory value may be stored in a binary fashion, wherein it may be set to "1" to command a dump and "0" otherwise. When the value is set to "dump," controller 37 may be said to be in a "dump state" and may send a signal to command dump actuator 18 to actuate and thereby effectuate a dump. In addition to controller 37, load counter 46 may also be configured to monitor this memory value in order to determine whether a dump has occurred. Load counter 46 may also be configured to record (i.e., incrementally count) a load when the memory value is determined to be "dump."

In order to increase accuracy and/or reliability of load counter 46, counting performed by load counter 46 may be conditional on other operational information about work machine 10. Such information may include ground speed and/or the amount of time that dump control device 24 and/or controller 37 remain in a "dump state."

For example, load counter 46 may be enabled to record a load upon the ground speed of work machine 10 exceeding a certain predetermined threshold (e.g., 5 mph). This condition may prevent recording of loads in situations when work machine 10 has dumped without having hauled the load anywhere.

As an additional condition, enabling of the load counter may occur if the ground speed threshold is exceeded while neither of dump control device 24 and controller 37 is in a dump state. More specifically, the enabling may occur upon exceeding the ground speed threshold while the command state is determined to be a "float" state, wherein the hydraulics that control the movement of dump body 16 are at rest, thus allowing dump body 16 to move freely (e.g., drop down and/or sit freely at the bottom of its travel under its own weight). This condition may prevent load counter 46 from recording multiple loads when a single dump is performed while work machine 10 is traveling in excess of the ground speed threshold.

Ground speed may be determined by ground speed indicator 50. Ground speed indicator 50 may be any sensor or mechanism configured to determine or approximate the speed of work machine 10 relative to the ground. For example, ground speed indicator 50 may be a wheel speed sensor. Alternatively, ground speed indicator 50 may be a sensor associated with the transmission that indicates the rotational speed of one or more transmission components. As yet another alternative, ground speed indicator 50 may include a sensor configured to determine whether the transmission of work machine 10 is in a particular gear. For example, ground speed indicator 50 may determine whether the transmission of work machine 10 is in a gear higher than first gear. The use of gears above first gear may be indicative that the approximate ground speed of work machine 10 has exceeded a certain predetermined speed. For example, a determination that work machine 10 is in second gear or higher may be interpreted as an indication that work machine 10 has traveled at a particular speed, which may indicate that work machine 10 has transported the load. Alternatively or additionally, a positioning system, such as a global positioning system (GPS) may be used to determine the ground speed of work machine 10.

Alternatively or additionally, load counter 46 may be enabled based on the output of a positioning system (not shown). The positioning system could include, for example, one or more GPS receivers (not shown) to determine an actual change in location of work machine 10. For example, the positioning system may determine a change in location of work machine 10, and/or a departure from, or arrival at a predetermined location. The positioning system may be satellite-based, laser-based, or any other type of positioning system capable of determining a position or a change in position of work machine 10.

Alternatively or additionally, load counter 46 may record a load (e.g., increment a dump cycle count) when the dump control device 24 and/or controller 37 remain in a "dump state" for a predetermined period of time. The predetermined period of time may be some portion of the amount of time that it takes to fully actuate dump actuator 18. For example, the predetermined period of time may be less than the total time required to completely dump a payload of known quantity.

The predetermined period of time can be set to any desired quantity and further may, in some applications, be selectable by an owner, operator, etc. In certain applications, it may be desirable for the predetermined period of time to be relatively short (e.g., five seconds). In particular embodiments, it may even be desirable for the predetermined period of time to be zero, thus enabling virtually instantaneous recordation of a dump cycle upon recognition of a dump state.

In an exemplary embodiment, the predetermined period may be approximately five seconds, whereas some hauling vehicles may take approximately ten to twenty seconds for the dump actuator to fully extend. When setting and/or selecting the predetermined period, one possible consideration could be whether actuation resulting in only a minute extension of dump actuator 18 (e.g., several inches) is desired to be counted as a dump. At the other end of the spectrum, another possible consideration may be whether a substantial, but incomplete, extension of dump actuator 18 (e.g., 75% of full extension) is desired to be counted as a dump.

Load counter 46 may also be configured to record additional operational information related to the operation of work machine 10. This additional information may include data regarding, for example, distance traveled, operation time, fuel consumption and/or any other data for which it may be desired to keep a record. Further, load counter 46 may be configured to compile this data, as well as a dump cycle count, and determine totals or subtotals for one or more categories of data. These totals or subtotals may be established for a particular task or group of tasks (e.g., a dump cycle, moving a stockpile, etc.), for a selected time period (e.g., hour, day, month, year, work shift, rental period, lifetime of the machine, etc.), and/or for a particular body of work (e.g., work done at a particular jobsite or by a specific operator, etc.).

Load counter 46 may be configured to keep track of distance traveled by work machine 10 in a forward direction and in a reverse direction separately. This data may be collected with odometer 52, or any other device or system for monitoring distance traveled.

Travel direction selector 54 may allow an operator to select which direction work machine 10 may travel (i.e., forward or reverse). Travel direction selector 54 may be a gear selector (e.g., levers, buttons, etc.), capable of selecting among one or more forward gears and one or more reverse gears.

Alternatively, travel direction selector 54 may simply choose between a forward, reverse, and neutral, travel directions. Certain embodiments may include this sort of travel direction selector 54, but may have more than one forward gear and/or more than one reverse gear. Such embodiments of work machine 10 may include automatic transmissions that may automatically choose the appropriate gear. For example, if travel direction selector 54 has been set to "forward," the transmission may choose whichever forward gear is appropriate for the operating conditions of work machine 10. Embodiments with multiple reverse gears may operate in a similar manner.

Information from odometer 52 and travel direction selector 54 may be processed by load counter 46 to determine how far work machine 10 has traveled in each direction. Alternatively, work machine 10 may have two of odometer 52, one for each direction. Further, the distance traveled in a forward direction may be combined with the distance traveled in a reverse direction to yield a total distance traveled.

Load counter 46 may also monitor fuel consumption using information from fuel usage meter 56. Fuel usage meter 56 can be any device or system configured to determine the amount of fuel used during a given period of time, over a particular distance traveled, or during completion of a particular task or group of tasks. Alternatively or additionally, load counter 46 may be configured to use information from fuel usage meter 56 and odometer 52 to determine fuel efficiency. Fuel consumption may be monitored in any other suitable way depending on the particular application.

Figure 4:
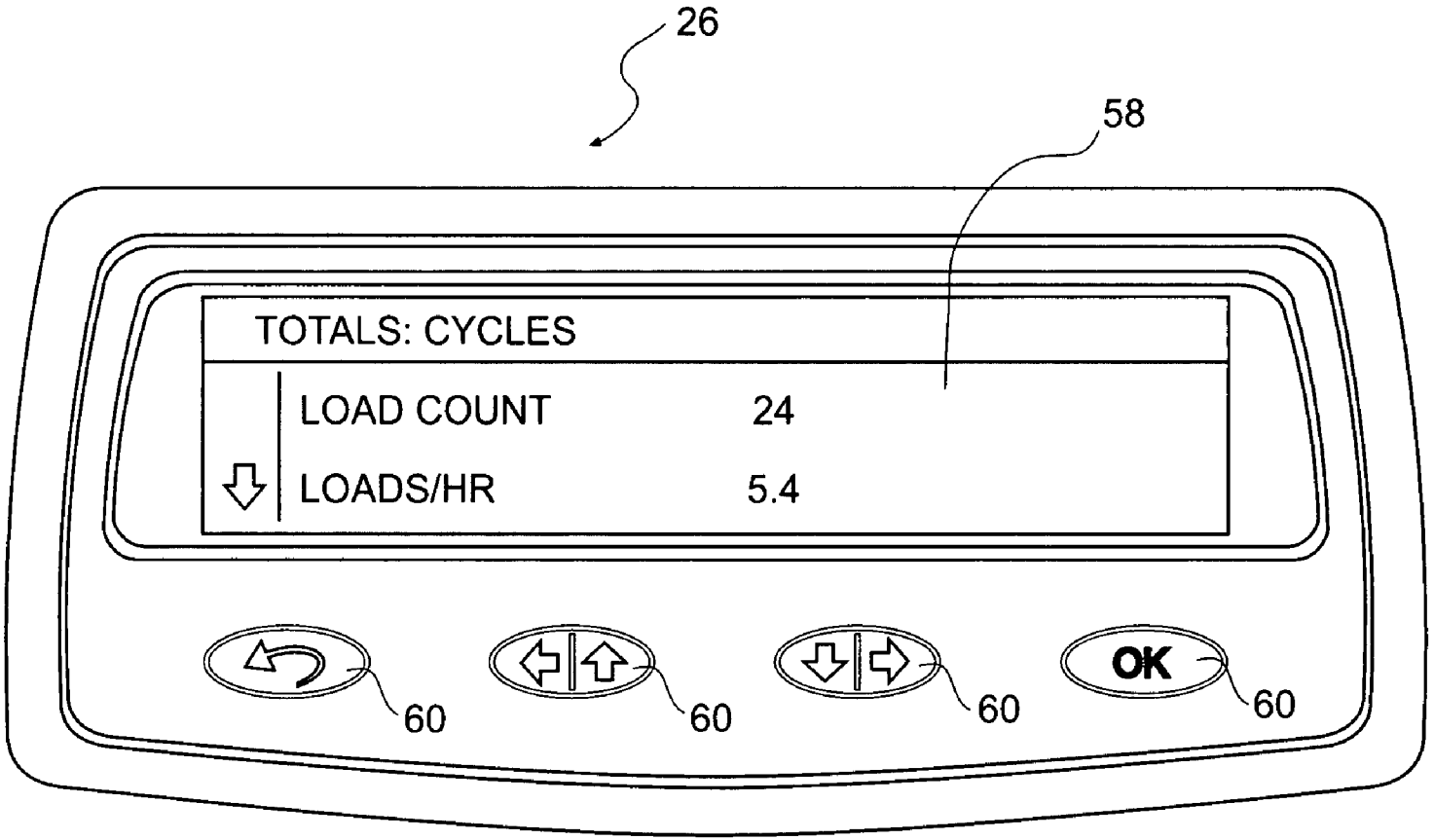
FIG. 4 is a diagrammatic illustration of a display for a dump cycle counting and monitoring system according to an exemplary disclosed embodiment.

Display 26 may display data acquired and/or processed by load counter 46. FIG. 4 illustrates an embodiment of display 26 showing an exemplary set of totals. Display 26 may list all totals on a single screen or, alternatively, display 26 may scroll or be menu driven. Display 26 may include a screen 58, and buttons 60 for navigation through one or more menus. In lieu of one or more of buttons 60, display 26 may include any other type of control input, such as, for example, knobs, dials, etc. As an additional alternative, display 26 may include a touchscreen, and/or may include "softkeys."

The following charts illustrate exemplary totals and subtotals that may be established by load counter 46, and possible menu categories under which they may fall. For example, Chart 1 below shows totals that may be established on a per cycle basis. The first column indicates a subcategory entitled "LOADS," under which two subtotals are listed, namely, the "Load Count" (i.e., number of dump cycles) and the number of loads that are being made per hour ("Loads/Hour"). These two subtotals are shown by example in FIG. 4.

Also in Chart 1, two other subcategories, "TIMES" and "DISTANCES," may be selected in order to view subtotals for the amount of wait time per cycle, the total time per cycle, the distance traveled per cycle, and the amount of fuel consumed per cycle. Charts 2-4 display additional totals and subtotals that may be recorded by load counter 46 and/or displayed by display 26.

CHART 1

| CYCLES | | |
|---|---|---|
| LOADS | TIMES | DISTANCES |
| Load Count | Wait Time/Cycle | Distance/Cycle |
| Loads/Hour | Total Time/Cycle | Fuel/Cycle |

CHART 2

| CURRENT JOB | | |
|---|---|---|
| DISTANCES | TIMES | FUEL |
| Forward Dist. | Wait Hours | Fuel Used |
| Reverse Dist. | Total Hours | Fuel/Hour |

CHART 3

| JOBSITE TOTALS | | |
|---|---|---|
| LOADS | DISTANCES | TIMES |
| Load Count | Forward Dist. | Wait Hours |
| | Reverse Dist. | Total Hours |

CHART 4

| LIFETIME TOTALS | | |
|---|---|---|
| LOADS | DISTANCES | TIMES |
| Load Count | Forward Dist. | Wait Hours |
| | Reverse Dist. | Total Hours |

Figure 5:
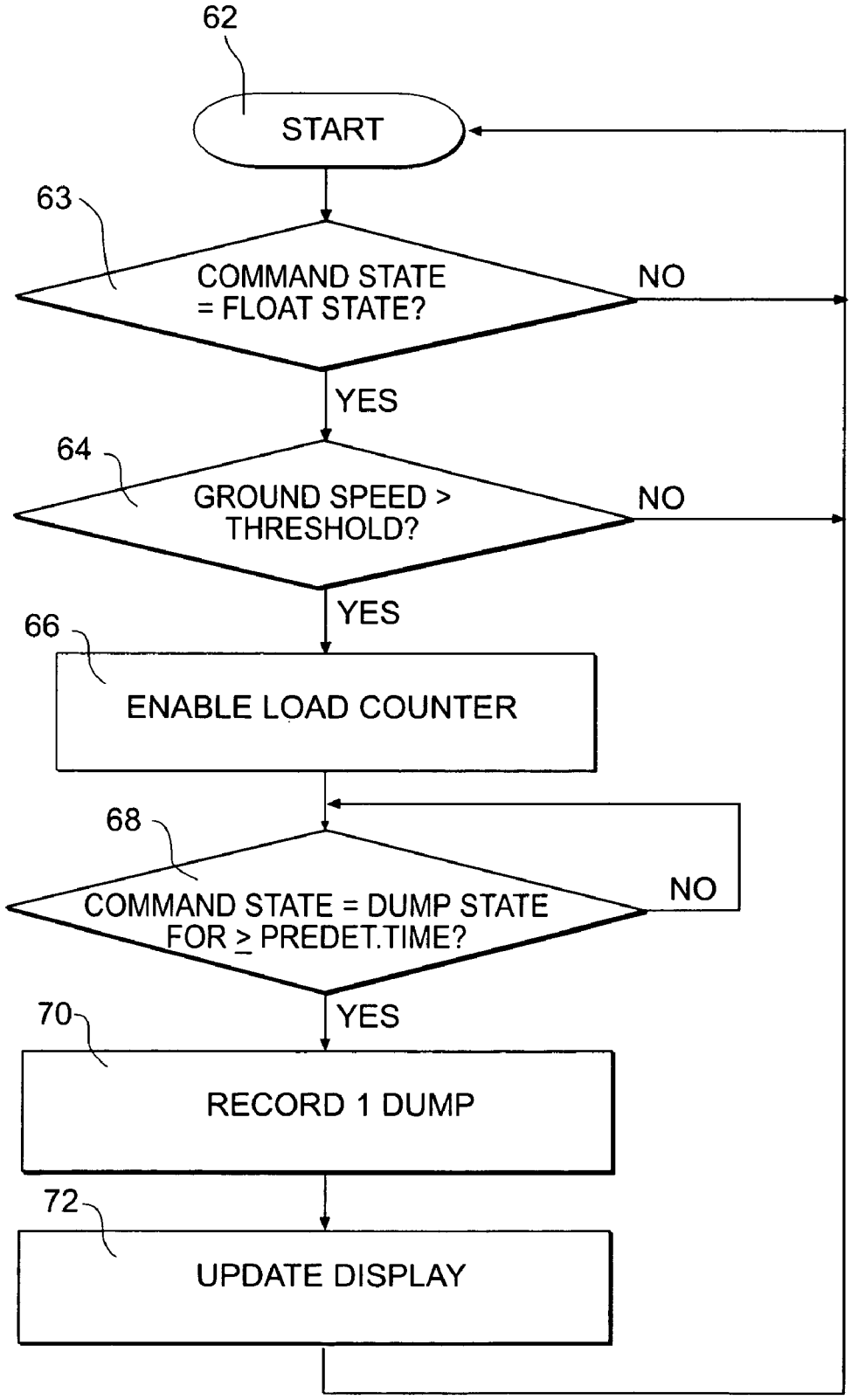
FIG. 5 is a flow chart representation of control logic for a dump cycle counting and monitoring system according to an exemplary disclosed embodiment.

FIG. 5 shows exemplary control logic that the disclosed system may follow. At step 62 the routine may start and at step 63, the routine may determine whether the command state of dump control device 24 and/or controller 37 is a float state. If not, then the routine may loop back to start. If the command state is a float state, then the routine may proceed to step 64, where it may determine whether the ground speed of work machine 10 is greater than a predetermined threshold. If not, the routine may loop back to start. If the ground speed has exceeded the threshold, then load counter 46 may be enabled (step 66) and the routine may proceed to determine whether the command state of dump control device 24 and/or controller 37 has been a dump state for at least a predetermined period of time (step 68). If not, then the routine may loop back to perform step 68 again. If the command state has been a dump state for at least the predetermined period of time, then load counter 46 may record a dump (step 70) and display 26 may be updated accordingly (step 72). Once a single dump has been recorded, the second dump will complete a full dump cycle (i.e., from dump to dump). Therefore, any totals such as time per dump cycle, may be established at the time the second dump is completed.

INDUSTRIAL APPLICABILITY

The disclosed system may be applicable to any type of hauling vehicle with a dump mechanism. The disclosed system may be useful for monitoring productivity of a work machine and/or operator, as well as for scheduling maintenance for the work machine (e.g., it may be desirable to service dump actuator 18 every so many dump cycles).

The disclosed system may be original equipment, but also lends itself well to retrofit applications due to minimal hardware componentry. Some embodiments of the disclosed system may determine, without the use of sensors, whether a dump has occurred. For such embodiments, the lack of sensors may translate into fewer components to be installed in order to retrofit the system to a machine. Some embodiments may consist completely of computer programming, and thus installation may include downloading of new instructions to or reprogramming of controller 37 (i.e., load counter 46 may be integral with controller 37 in the form of computer code).

Other embodiments may include load counter 46 as a separate piece of hardware, which may or may not include software. Such systems may be in a "piggyback" configuration, where a new processor (e.g., load counter 46) is "piggybacked" onto an existing processor (e.g., controller 37). That is, rather than reprogramming an existing processor, a new processor may be separately installed and tied into the existing processor. As yet another alternative, controller 37 may be replaced altogether with a new processor that incorporates the functions of both controller 37 and load counter 46. Some embodiments may include display 26 and software to perform the functions of load counter 46. In such embodiments, hardware installation may consist solely of display 26. Again, any software changes could be achieved by downloading, reprogramming, or component replacement.

The disclosed system may also minimize or prevent padding of a load count because of several design features. First, the system, in some embodiments, may determine whether a dump has occurred (i.e., whether the command state of dump control device 24 and/or controller 37 is a dump state) without the use of sensors. In particular, in embodiments where controller 37 is a processor, the command state of controller 37 may be indicated by values associated with the memory of controller 37. Therefore, the command state of controller 37 may be determined by monitoring its memory, which does not require a sensor.

Second, padding may be curtailed in the current system by employing a ground speed threshold condition. In some embodiments, load counter 46 may be enabled to record a dump cycle only if work machine 10 has exceeded a predetermined ground speed, for example, since the last dump. Because of this threshold condition, an operator may be prevented from padding the dump cycle count by actuating the dump actuator repeatedly without moving the machine above the predetermined speed in between each dump.

Third, padding may be curtailed, in certain embodiments, where time is recorded. For example, if load counter 46 is configured to record the amount of time it takes to complete each dump cycle, and an operator performs an extra actuation of dump actuator 18 halfway through the dump cycle, then this may be recorded in the stored data. Persons reviewing the dump cycle data may recognize that at least one of the dump cycles took substantially less time to complete than the rest. Similarly, recording the distance traveled during dump cycles may enable persons reviewing dump cycle data to spot potential fraudulent dumps. For example, if it is known that work machine 10 is transporting loads approximately ten miles from load site to dump site, then the total distance traveled for each dump cycle should be recorded as roughly twenty miles. However, if there is an outlying data point, such as, for example, a dump cycle that indicates five miles were traveled, then this may raise suspicion that one or more dumps may be fraudulent.

Appropriate selection of a predetermined amount of time that a dump state must exist in order to enable dump counter 46 may render the system capable of recording dumps that might otherwise go unrecognized, and capable of disregarding others that are not desired to be considered a dump. In a work machine that takes ten to twenty seconds to complete full extension of dump actuator 18, by looking for dump control device 24 and/or controller 37 to remain in a dump state for about five seconds (i.e., about one quarter to one half of the time it may take for full extension of dump actuator 18), load counter 46 may count periods of actuation that fall short of full extension of dump actuator 18 but may result in a complete dump of the payload. For example, in some instances, an operator may wish to only raise dump body 16 by a small amount in order to dump a payload slowly. The operator may also move work machine 10 forward slowly while dumping the payload slowly, in order to spread out the payload along the ground. In this circumstance, monitoring for a dump state of a shorter duration (e.g., five seconds) may enable load counter 46 to recognize this type of complete offload of the payload to be a dump, and record a dump cycle accordingly, despite dump body 16 not being completely raised.

Further, load counter 46 may avoid counting periods of actuation of dump actuator 18 that may be too short to effectuate dumping of the payload. For example, in some circumstances, a operator of work machine 10 may raise dump body 16 by a small amount in order to shift the center of gravity of the payload so that it is over the rear wheels for purposes of traction. It may be undesirable to count this minor adjustment as a dump, as it might not result in any offloading of the payload. Therefore, requiring a dump state to exist for a more substantial amount of actuation of dump actuator 18 (e.g., five seconds) may avoid counting a minute extension of dump actuator 18 that results from, say, one second of actuation, as a dump.

Some embodiments of the system may require detection of less than full actuation of dump actuator 18 in order to record a dump cycle, which may make for a less complicated system. For example, less data and/or fewer events must be monitored in order to determine that a dump has occurred. Accordingly, this may be accomplished with simpler computer code in some embodiments. In addition, detection of less than a full actuation of dump actuator 18 may enable dumps to be recorded that otherwise would not, such as where an operator may dump the payload by lifting dump body 16 less than the full amount, as described above.

It will be apparent to those skilled in the art that various modifications and variations can be made to the disclosed dump cycle counting and monitoring system without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A dump cycle counting system for a machine, comprising:

a payload carrier configured to contain a payload of material;

a dump actuator configured to effectuate dumping of the payload out of the payload carrier;

a controller configured to control actuation of the dump actuator; and a load counter configured to record at least one dump cycle based on a command state of the controller;

wherein the command state of the controller corresponds to a memory value associated with the controller, wherein the load counter is configured to record one dump cycle only after the command state corresponds to a dump state for a period greater than or equal to a predetermined amount of time greater than zero.

2. The system of claim 1, further including a display configured to display a dump cycle count.

3. The system of claim 2, wherein the display is configured to display at least one of time, distance, and fuel consumption associated with a dump cycle.

4. The system of claim 1, wherein the predetermined amount of time is less than a total time required to completely dump the payload.

5. The system of claim 1, wherein the load counter is enabled to record at least one dump cycle upon the machine reaching a predetermined ground speed greater than zero.

6. The system of claim 1, wherein the load counter is enabled to record at least one dump cycle based on a change in location of the machine as determined by a positioning system.

7. The system of claim 6, wherein the positioning system includes at least one global positioning system (GPS) receiver.

8. The system of claim 1, wherein the dump actuator is configured to effectuate dumping of the payload by lifting the payload carrier at an angle relative to a frame of the machine.

9. The system of claim 1, wherein the dump actuator is configured to effectuate dumping of the payload by moving an ejector plate to push payload material out of the payload carrier.

10. The system of claim 1, wherein the load counter is configured to record additional operational information about at least one dump cycle, the information including at least one of time, distance traveled, and fuel consumption.

11. The system of claim 1, wherein recorded information related to dump cycles is configured to be provided to an entity external to the machine.

12. A machine, comprising:

a power source;

one or more traction devices;

a payload carrier configured to contain a payload of material;

a dump actuator configured to effectuate dumping of the payload out of the payload carrier;

a controller configured to control actuation of the dump actuator; and a load counter configured to record at least one dump cycle based on a command state of the controller, the load counter further being enabled to record the at least one dump cycle once the work machine has exceeded a predetermined ground speed greater than zero, and the command state has remained, for at least a predetermined amount of time greater than zero, a state corresponding to a dump state.

13. The machine of claim 12, wherein the predetermined amount of time is less than a total time required to completely dump a payload of known quantity.

14. The machine of claim 12, further including a display configured to display a dump cycle count.

15. A computer readable medium, comprising:

instructions for monitoring a command state of at least one of a dump control device and a controller operatively coupled to a dump actuator of a machine, the dump actuator being configured to effectuate dumping of a payload of material out of a payload carrier of a machine;

enabling a load counter, upon the machine exceeding a predetermined ground speed greater than zero, to record at least one dump cycle; and recording at least one dump cycle based on the monitored command state.

16. The computer readable medium of claim 15, wherein the command state of the dump control device corresponds to at least one of a position of the dump control device and a signal generated by the dump control device.

17. The computer readable medium of claim 15, wherein the controller includes a hydro-mechanical control system and the command state of the controller corresponds to an operating parameter of the hydro-mechanical control system.

18. The computer readable medium of claim 15, further including instructions for recording the at least one dump cycle in response to the command state corresponding to a dump state for at least a predetermined period of time.

19. The computer readable medium of claim 15, further including instructions for enabling a load counter to record at least one dump cycle based on a change in location of the machine as determined by a positioning system.

20. The computer readable medium of claim 15, further including instructions for recording and or displaying additional operational information about at least one dump cycle, the information including at least one of time, distance traveled, and fuel consumption.

21. A dump cycle counting system for a machine, the machine including a payload carrier configured to contain a payload of material, a dump actuator configured to effectuate dumping of the payload out of the payload carrier, and a controller configured to control actuation of the dump actuator, wherein the counting system, comprises:

a load counter configured to record at least one dump cycle based on a command state of the controller, wherein the command state of the controller corresponds to a memory value associated with the controller, wherein the load counter is configured to record one dump cycle only after the command state corresponds to a dump state for a period greater than or equal to a predetermined amount of time greater than zero.

22. The system of claim 21, further including a display configured to display a dump cycle count, wherein the display is configured to display at least one of time, distance, and fuel consumption associated with a dump cycle.

23. The system of claim 21, wherein the predetermined amount of time is less than a total time required to completely dump the payload.

24. The system of claim 21, wherein the load counter is enabled to record at least one dump cycle upon the machine reaching a predetermined ground speed greater than zero.

25. The system of claim 21, wherein the load counter is enabled to record at least one dump cycle based on a change in location of the machine as determined by a positioning system.

26. The system of claim 25, wherein the positioning system includes at least one global positioning system (GPS) receiver.

27. The system of claim 21, wherein the load counter is configured to record additional operational information about at least one dump cycle, the information including at least one of time, distance traveled, and fuel consumption.

28. A dump cycle counting system for a machine, the machine including a payload carrier configured to contain a payload of material, a dump actuator configured to effectuate dumping of the payload out of the payload carrier, a controller configured to control actuation of the dump actuator, and a dump control device operatively coupled to the controller, wherein the counting system, comprises:

a load counter configured to record at least one dump cycle based on a command state of at least one of the dump control device and the controller, wherein the load counter is enabled to record the at least one dump cycle once the machine has exceeded a predetermined ground speed greater than zero.

29. The system of claim 28, wherein the command state of the dump control device corresponds to at least one of a position of the dump control device and a signal generated by the dump control device.

30. The system of claim 28, wherein the command state of the controller corresponds to a memory value associated with the controller.

31. The system of claim 28, further including a display configured to display a dump cycle count, wherein the display is configured to display at least one of time, distance, and fuel consumption associated with a dump cycle.

32. The system of claim 28, wherein the load counter is configured to record one dump cycle only after the command state corresponds to a dump state for a period greater than or equal to a predetermined amount of time greater than zero.

33. The system of claim 32, wherein the predetermined amount of time is less than a total time required to completely dump the payload.

34. The system of claim 28, wherein the load counter is configured to record additional operational information about at least one dump cycle, the information including at least one of time, distance traveled, and fuel consumption.

35. The system of claim 28, wherein the condition of ground speed exceeding the predetermined ground speed is satisfied if the load counting system determines that the machine is in a transmission gear above a predetermined gear.

36. The system of claim 28, wherein the condition of ground speed exceeding the predetermined ground speed is satisfied if the load counting system determines that a rotational speed of one or more components of a transmission of the machine is above a predetermined speed greater than zero.

37. The system of claim 28, wherein the condition of ground speed exceeding the predetermined ground speed is satisfied if the load counting system determines that a wheels speed of the machine is above a predetermined speed.

38. The system of claim 4, wherein the predetermined amount of time is about one quarter to one half of the total time required to completely dump the payload.

39. The system of claim 28, wherein the load counter is enabled to record the at least one dump cycle once the machine has exceeded a predetermined ground speed greater than zero independent of a position of the dump actuator.

40. The machine of claim 12, wherein the load counter is enabled to record the one dump cycle independent of a number of times the dump actuator is actuated.

* * * * *